US005666636A

United States Patent [19]

Park et al.

[11] Patent Number: 5,666,636

[45] Date of Patent: Sep. 9, 1997

[54] PROCESS FOR PREPARING SINTERED TITANIUM NITRIDE CERMETS

[75] Inventors: Jong Ku Park; Sung Tae Park, both of Kyonggi-do, Rep. of Korea

[73] Assignee: Korea Institute of Science and Technology, Seoul, Rep. of Korea

[21] Appl. No.: 621,099

[22] Filed: Mar. 22, 1996

[30] Foreign Application Priority Data

Sep. 23, 1995 [KR] Rep. of Korea ..... 95-31529

[51] Int. Cl.[6] ..... B22F 1/00

[52] U.S. Cl. ..... 419/13; 419/14; 419/38; 419/47; 419/57; 419/60

[58] Field of Search ..... 419/11, 13, 14, 419/38, 47, 57, 60

[56] References Cited

U.S. PATENT DOCUMENTS

| | | | |
|---|---|---|---|
| 4,973,355 | 11/1990 | Takahasi et al. | 75/233 |
| 4,983,212 | 1/1991 | Iyori et al. | 75/238 |
| 4,985,070 | 1/1991 | Kitamura et al. | 75/238 |
| 5,296,016 | 3/1994 | Yoshimura et al. | 75/238 |
| 5,306,326 | 4/1994 | Oskarsson et al. | 75/238 |
| 5,403,542 | 4/1995 | Weinl et al. | 419/13 |
| 5,460,893 | 10/1995 | Teruuchi et al. | 428/552 |

OTHER PUBLICATIONS

Journal of the Japan Institute of Metals, vol. 42, pp. 582–588, 1978, H. Mitani, et al., "On the Sintering of the TiN–Ni Binary Compacts".

Journal of the Japan Institute of Metals, vol. 43, pp. 169–174, 1979, M. Fukuhara, et al., "On the Phase Relationship and the Denitridation During the Sintering Process of the TiN–Ni Mixed Powder Compacts".

Journal of the Japan Society of Powder and Powder Metallurgy, vol. 26, pp. 143–148, M. Fukuhara, et al., "On the Sintering of the $TiN_x$–Ni Binary Mixed Powder Compacts", 1979.

Transactions of the Japan Institute of Metals, vol. 21, No. 4, pp. 211–218, Apr. 1980, Mikio Fukuhara, et al., "The Phase Relationship and Denitrification During the Sintering Process of TiN–Ni Mixed Powder Compacts".

*Primary Examiner*—Peter A. Nelson
*Assistant Examiner*—Anthony R. Chi
*Attorney, Agent, or Firm*—Oblon, Spivak, McClelland, Maier & Neustadt, P.C.

[57] ABSTRACT

The present invention provides a process for preparing titanium nitride sintered masses having no residual pores and consisting of TiN solid solution particles and Ni solid solution matrix, in which a granulated powder of the following composition:

$TiN\text{-}pMo_2C\text{-}qC\text{-}rNi\text{-}sMeC$ wherein:

p is 5 to 20 wt %;

q is 0 to 1.5 wt %;

r is 15 to 30 wt %;

s is 0 to 5 wt %;

MeC is one or more carbides selected from VC, WC, TaC and NbC;

with the proviso that q and s are not 0 wt % simultaneously;

is compacted and sintered. The process according to the present invention can provide sintered TiN cermets of high density and a small grain size.

4 Claims, No Drawings

PROCESS FOR PREPARING SINTERED TITANIUM NITRIDE CERMETS

BACKGROUND OF THE INVENTION

1. Field of the Invention

The present invention relates to a process for preparing sintered titanium nitride (TiN) cermets. More particularly, the present invention relates to a process for preparing sintered titanium nitride cermets, wherein thermal decomposition of titanium nitride is prevented due to the remarkably improved wettability of the particle surfaces of TiN powder with respect to the nickel liquid phase.

2. Description of the Prior Art

Generally, titanium nitride has a high hardness and good heat resistance as well as a golden luster. Titanium nitride is mainly used in the field of ornamental materials and cutting tools. Although titanium nitride has characteristics that are useful for ornamental materials and cutting tools, its physical properties are exhibited when it is coated onto other materials because of some difficulties in its preparation.

Since the melting point of titanium nitride is 2927° C., its fabrication is almost impossible by conventional material processing methods. The only available method is to prepare titanium nitride powders and produce sintered masses therefrom.

The high melting point, however, requires a very high temperature to consolidate titanium nitride powders. Like other nitrides, titanium nitride decomposes thermally when it is sintered at a high temperature. Accordingly, a sintering method that enables the lowering of the sintering temperature is a key to a better process for producing sintered titanium nitride cermets.

Sintering aids which accelerate densification are required to sinter titanium nitride powders at a relatively low temperature. There are very few publications dealing with the sintering of titanium nitride powders. Mitani and Fulmhara obtained a sintered density greater than 93% of the theoretical value. See H. Mitani, H. Nagai and M. Fukuhara, *Journal of the Japan Institute of Metals,* 42, 582 (1978); M. Fukuhara and H. Mitani, *Journal of the Japan Institute of Metals,* 43, 169 (1979); M. Fukuhara and H. Mitani, *Trans. JIM,* 21,211 (1980); and M. Fukuhara and H. Mitani, *Journal of the Japan Society of Powder and Powder Metallurgy,* 26, 143 (1979). Mitani and Fukuhara employed a liquid phase sintering method wherein nickel powder is added as a sintering aid and sintering is performed at a temperature above 1353° C. (1626 K.) where the nickel liquid phase appears.

However, a disadvantage in the above method is that thermal decomposition of titanium nitride is not prevented during sintering. Thermal decomposition results in the formation of pores due to the nitrogen gas that is produced during thermal decomposition and results in a sintered mass with incomplete densification.

The occurrence of residual pores during the sintering of titanium nitride results because the liquid phase of nickel does not completely cover the titanium nitride particles at the sintering temperature. As a result of continued research to overcome the above disadvantages, the present invention was completed by means of preventing thermal decomposition of titanium nitride by remarkably improving its wettability to the nickel liquid phase.

SUMMARY OF THE INVENTION

It is an object of the present invention to provide a process for producing sintered titanium nitride cermets with a high density greater than 99.5% by overcoming the problem of thermal decomposition during sintering.

It is another object of the present invention to provide a process for producing sintered titanium nitride cermets having a fine grain structure.

These and other objects of the present invention can be achieved by a process for preparing sintered titanium nitride cermets having no residual pores and consisting of TiN solid solution particles and a Ni solid solution matrix, comprising the steps of:

(a) providing a granulated powder of the following composition:

$$TiN\text{-}pMo_2C\text{-}qC\text{-}rNi\text{-}sMeC$$

wherein:

p is 5 to 20 wt %;

q is 0 to 1.5 wt %;

r is 15 to 30 wt %;

s is 0 to 5 wt %; and

MeC is one or more carbides selected from VC, WC, TaC and NbC;

with the proviso that q and s are not 0 wt % simultaneously;

(b) compacting the granulated powder; and (c) sintering the powder compacts.

DETAILED DESCRIPTION OF THE INVENTION

In the process of the present invention, molybdenum carbide ($Mo_2C$) or both molybdenum and carbon are added to a TiN-Ni system in order to enhance the wettability of the surface of TiN particles by the nickel liquid phase.

In the process for producing sintered TiN cermets according to the present invention, the grain size of the TiN solid solution particles can be reduced by the addition of one or more carbides selected from VC, WC, TaC and NbC. The average grain size obtained by the addition of these materials is below 5 μm. This value is remarkable as compared with the value obtained when such a carbide is not added, namely about 10 μm.

The powder mixtures with appropriate ratios are wet ground by a ball mill for about 72 hours. The milled slurry is dried and granulated into a powder. The granulated powder is poured into the die cavity and pressed into a compact.

The sintering in step (c) of the process according to the present invention is performed by liquid phase sintering wherein the powder mixture is sintered at a temperature at which the Ni liquid phase is formed, that is, above 1353° C. The sintering can be carried out under a vacuum or under an appropriate nitrogen pressure.

By means of the process according to the present invention, it is possible to produce sintered titanium nitride cermets having substantially no residual pores, which have never been obtained by conventional processes.

DESCRIPTION OF THE PREFERRED EMBODIMENTS

The present invention will be illustrated in greater detail by way of the following examples. The examples are presented for illustration purpose only and should not be construed as limiting the invention, which is properly delineated in the claims.

EXAMPLE 1

TiN, $TiN_{0.85}$, $Mo_2C$ and Ni powders of purity above 99.9% were used in this example. Average particle sizes of the powders were from 2 to 4 μm. Various amounts of $Mo_2C$ and C powders were added to a basic composition composed of 80% TiN-20% Ni. The mixed powders were then wet ground in a ball mill for 72 hours in the presence of acetone. The ground powders were dried in a vacuum oven and granulated using a 120 mesh sieve. 1.5 g of the granulated powders were compacted at about 10 MPa in a separate partition type mold. The powder compacts were sintered at above 1353° C. in a vacuum furnace using a graphite heater while maintaining a vacuum of below 10 Pa. The sintered masses with various compositions were examined for relative sintered density, leakage of the liquid phase and average grain size.

The results are shown in Table 1. In sample Nos. 1 to 8, formation of a second phase other than the TiN solid solution Ni solid solution was observed. When the amount of carbon added was below 0.5%, a small amount of the liquid phase leaked to the surface of the samples.

EXAMPLE 2

The same powders as used in Example 1 were sintered in a sintering furnace at the same temperature and for the same period as in the example. However, the sintering furnace was heated to 700° C. after the internal pressure reached a vacuum below 10 Pa. At this temperature, highly pure nitrogen gas was introduced into the furnace to maintain the pressure at around 200 Pa and the furnace was then heated to 1450° C. After the sintering, properties of the sintered compacts thus produced were examined as in Example 1 and found to be identical with those obtained in Example 1.

TABLE 1

| Composition (Wt %) | Sintering Condition | Relative Sintered Density | Liquid Phase Leakage | Average Grain Size | Sample No. |
|---|---|---|---|---|---|
| TiN-20% Ni | 1450° C., 2 h | 94.5% | extremely severe | — | 2 |
| TiN-5% $Mo_2C$-20% Ni | 1450° C., 2 h | 96.0% | very severe | — | 1 |
| TiN-5% $Mo_2C$-20% Ni | 1450° C., 1.5 h | 96.0% | very severe | — | 4 |
| TiN-10% $Mo_2C$-15% Ni | 1450° C., 1 h | 97.5% | severe | — | 7 |
| TiN-30% $Mo_2C$-15% Ni | 1450° C., 1 h | 98.0% | severe | — | 6 |
| TiN-20% $Mo_2C$-20% Ni | 1450° C., 2 h | ~100% | liquid drop | — | 3 |
| TiN-20% $Mo_2C$-20% Ni | 1450° C., 2 h | ~100% | moderate | — | 5 |
| $TiN_{0.85}$-20% $Mo_2C$-20% Ni | 1450° C., 1 h | ~100% | moderate | — | 8 |
| TiN-20% $Mo_2C$-20% Ni-0.3% C | 1450° C., 1 h | ~100% | very little | 7–8 μm | 13 |
| $TiN_{0.85}$-20% $Mo_2C$-20% Ni-0.3% C | 1450° C., 1 h | ~100% | moderate | | 11 |
| $TiN_{0.85}$-20% $Mo_2C$-20% Ni-0.3% C | 1450° C., 1 h | ~100% | liquid drop | | 12 |
| $TiN_{0.85}$-20% $Mo_2C$-20% Ni-0.5% C | 1450° C., 1 h | ~100% | very little | | 9 |
| $TiN_{0.85}$-20% $Mo_2C$-20% Ni-0.5% C | 1450° C., 1 h | ~100% | very little | | 10 |
| TiN-20% $Mo_2C$-15% Ni-0.5% C | 1450° C., 1 h | ~100% | very little | | 14 |

TABLE 1-continued

| Composition (Wt %) | Sintering Condition | Relative Sintered Density | Liquid Phase Leakage | Average Grain Size | Sample No. |
|---|---|---|---|---|---|
| TiN-20% $Mo_2C$-20% Ni-0.5% C | 1450° C., 1 h | ~100% | no | | 15 |
| TiN-8% $Mo_2C$-24% Ni-0.5% C | 1450° C., 2 h | ~100% | no | | 22 |
| TiN-10% $Mo_2C$-25% Ni-0.5% C | 1450° C., 2 h | ~100% | no | | 23 |
| TiN-10% $Mo_2C$-30% Ni-0.5% C | 1450° C., 2 h | ~100% | no | | 18 |
| TiN-5% $Mo_2C$-24% Ni-1.5% C | 1450° C., 2 h | ~100% | no | | 38 |

EXAMPLE 3

Sintered compacts were prepared as in Example 1 except that powders were mixed according to the compositions shown in Table 2 and sintered under the conditions indicated therein. Relative sintered density and average grain size were measured for each sample. The results are shown in Table 2.

TABLE 2

| Composition (Wt %) | Sintering Condition | Relative Sintered Density | Average Grain Size | Sample No. |
|---|---|---|---|---|
| TiN-6% $Mo_2C$-24% Ni-0.3% C-3% VC | 1450° C., 2 h | ~100% | 3 μm | 42 |
| TiN-6% $Mo_2C$-24% Ni-3% VC | 1450° C., 2 h | ~100% | 2 μm | 43 |
| TiN-5% $Mo_2C$-24% Ni-0.3% C-5% WC | 1450° C., 2 h | ~100% | 3.5 μm | 45 |
| TiN-6% $Mo_2C$-24% Ni-0.3% C-3% NbC | 1450° C., 2 h | ~100% | 3 μm | 46 |
| TiN-6% $Mo_2C$-24% Ni-0.3% C-3% TaC | 1450° C., 2 h | ~100% | 2.5 μm | 47 |
| TiN-6% $Mo_2C$-24% Ni-0.3% C-2% TaC-3% VC | 1500° C., 2 h | ~100% | 2.5 μm | 48 |
| TiN-6% $Mo_2C$-24% Ni-0.3% C-2% VC-3% WC | 1450° C., 2 h | ~100% | 2.5 μm | 49 |

It should be understood that those skilled in the art would recognize various modifications and adaptations of the process within the spirit and scope of the present invention.

What is claimed is:

1. A process for preparing sintered titanium nitride cermets having no residual pores and consisting of TiN solid solution particles and Ni solid solution matrix, comprising the steps of:

(a) providing a granulated powder of the following composition:

$$TiN\text{-}pMo_2C\text{-}qC\text{-}rNi\text{-}sMeC$$

wherein:

p is 5 to 20 wt %;

q is 0 to 1.5 wt %;

r is 15 to 30 wt %;

s is 0 to 5 wt %;

MeC is one or more carbides selected from VC, WC, TaC and NbC;

with the proviso that q and s are not 0 wt % simultaneously;

(b) compacting the granulated powder; and (c) sintering the powder compacts.

2. The process of claim 1 wherein s is more than 0 and the average grain size of the TiN solid solution particles is below 5 μm.

3. The process of claim 1 or claim 2 wherein the step (c) is performed at a temperature of above 1353° C. where a liquid phase is formed.

4. The process of claim 3 wherein the step (c) is performed under vacuum or under a nitrogen pressure of 200 Pa or less.

* * * * *